US006182915B1

(12) United States Patent
Kvalsund et al.

(10) Patent No.: US 6,182,915 B1
(45) Date of Patent: Feb. 6, 2001

(54) DETENTIONING UNIT FOR RETRIEVAL OF AN ELONGATED BODY

(75) Inventors: Bård Kvalsund, Fosnavåg; Inge Dragsund, Ulsteinvik, both of (NO)

(73) Assignee: Odim Holding ASA (NO)

( * ) Notice: Under 35 U.S.C. 154(b), the term of this patent shall be extended for 0 days.

(21) Appl. No.: 09/295,346

(22) Filed: Apr. 21, 1999

(30) Foreign Application Priority Data

Apr. 21, 1998 (NO) ..... 19981772
Feb. 10, 1999 (NO) ..... 19990628

(51) Int. Cl.[7] ..... B66D 1/02

(52) U.S. Cl. ..... 242/364.2; 254/265; 254/290; 254/134.35 C

(58) Field of Search ..... 254/134 SC, 290, 254/278, 382, 265, 291, 292; 242/364.12, 364.2, 365.6, 366.4, 155 BW

(56) References Cited

U.S. PATENT DOCUMENTS 2,518,534 * 8/1950 Ertner ..... 242/364.2 X
2,599,603 * 6/1952 Barker .
2,785,890 * 3/1957 Gilfillan ..... 242/364.2
3,105,676 * 10/1963 Brockbank et al. .... 254/134.3 SC X
3,329,406 * 7/1967 Flair ..... 254/265 X
3,729,173 * 4/1973 Levardon .
3,927,867 * 12/1975 Herchenroder ..... 254/382 X
4,204,664 * 5/1980 Bryan, Jr. .
4,917,540 * 4/1990 Recalde ..... 254/134.3 SC X
4,920,680 * 5/1990 Lindgren .
5,082,248 * 1/1992 Harig .
5,141,170 * 8/1992 Sarfati ..... 242/364.2
5,512,506 * 4/1996 Chang .

FOREIGN PATENT DOCUMENTS

2631723 * 1/1978 (DE) .
2 616 138 * 12/1998 (FR) .
1 387 493 * 3/1975 (GB) .
2 028 250 * 3/1980 (GB) .
1 566 904 * 5/1980 (GB) .
2 294 442 * 5/1996 (GB) .
1 176 797 * 7/1989 (JP) .
364 930 * 11/1974 (SE) .

* cited by examiner

*Primary Examiner*—Donald P. Walsh
*Assistant Examiner*—Collin A. Webb
(74) *Attorney, Agent, or Firm*—Nixon & Vanderhye

(57) ABSTRACT

A detention unit is provided for retrieval of an elongated body (9), such as a cable. The unit includes two or more movable friction surfaces (1, 11) adapted to pull in the elongated body (9). The moveable friction surfaces (1, 11) are arranged relative to each other so that the elongated body (9) may bear or rest against at a part of at least two friction surfaces (1, 11) in a sequential manner. The part of the friction surfaces (1, 11) adapted to pull the elongated body (9) defines a arc section, and each friction surface is provided with a separate propulsion unit (3, 14).

19 Claims, 6 Drawing Sheets

DETENTIONING UNIT FOR RETRIEVAL OF AN ELONGATED BODY

BACKGROUND OF THE INVENTION

1. Field of the Invention

The present invention relates to a detention unit for a winch retrieving an elongated body, e.g., a cable, such as a seismic cable, to avoid damage to the elongated body by local high tension and too hard spooling of the cable at reels or winch drums.

2. Description of the Related Art

In the retrieval of elongated bodies such as cables and the like from the sea onboard a boat, the cables are normally retrieved by a winch and stored on storage reels or are reeled in on a winch drum for storage. Such devices are used for rope and wire of high strength. For more sensitive equipment, such as a seismic cable, however, the high tension and the pressure on the cable on the winch drum or reel while reeling up the cable, may result in a damaged cable. To solve this problem different detention units has been developed.

A known detention unit used e.g. for rope, comprises two discs facing each other to defined a wedge between them. This device gets a good grip on the rope if the tension is great so that the line to be retrieved is wedged between the discs. However, the pressure will lead to deformation and possible destruction of a seismic cable if it were pulled through the device.

Another solution comprises a frustoconical drum on which the elongated body is wound one or more turns. The rope, fishing net or longline to be retrieved enters the drum at the largest diameter and leaves the drum at a lesser diameter, to keep the elongated body in place. This device is not applicable for a sensitive cable, as the cable has to move relative to the drum and may be turned and thus damage the cable.

Another known approach is to use interconnected winches, where the cable to be retrieved is sequentially placed around the winches. To get adequate friction between the cable and the winches, the cable must either be turned several times around each winch or more than two winches have to be used. None of these solutions is acceptable for practical or economical reasons. A solution using several winches is both heavy and expensive, whereas several turns around each winch results in the above-mentioned problem relating to the movement of the cable against the winches.

Another solution used today for cables that can withstand rough handling, is a linear system where the cable is pulled by opposing wheels or conveyor belts. Using this type of device may result in a situation where the cable is starting to run out, because more tension is built up in the starting portion of the system than in the end of the system. This results in undesirable tension and strain on the cable and may result in jerky displacement of the cable. Thus, this solution is not applicable for sensitive cables.

JP 01.176.797, DE 2.631.723, GB 2.294.442 and U.S. Pat. No. 5.152.506 teach pulling in a cable by squeezing it between two endless belts. This solution may result in unacceptable pressure at sensitive parts of a seismic cable in addition to unacceptable local tension on the cable.

SE 364.930 teaches a device for retrieval of a cable, having an endless belt to retrieve the cable and pull the cable towards a reel or winch drum. The device does not provide sufficient detention for the cable and if the tension becomes great the cable might slip against the conveyor and may be damaged.

U.S. Pat. No. 5.082.248 teaches a device having an endless belt pulling, guiding, and pressing the cable towards a drum. This device is not sufficiently gentle for a sensitive seismic cable.

GB 1.566.904 teaches a device using an endless track helically wound around a plurality of drive shafts and where the elongated body is pulled in by means of the endless track. The endless track provides a large contact surface between the track and the elongated body. If the tension becomes too great the elongated body might slip against the track, producing high local tension that may damage the cable.

SUMMARY OF THE INVENTION

It is an object of the present invention to provide a detention unit that treats an elongated body, such as a sensitive cable, gently during retrieval, and overcomes the shortcomings of the units described above.

According to the present invention there is provided a detention unit for retrieval of an elongated body, such as a cable, comprising two or more movable friction surfaces adapted to pull in the elongated body, wherein the moveable friction surfaces are arranged relative to each other so that the elongated body may bear or rest against a part of at least two friction surfaces in a sequential manner, the part of the friction surfaces adapted to pull the elongated body defining an arc section, and each friction surface being provided with a separate propulsion unit.

As each moveable friction surface has its own population unit the tractive power for each friction surface may be adjusted so that the local tractive power is kept low enough not to damage the cable. The number of friction surfaces is selected so that the total tractive power from all the friction surfaces are sufficient to pull in the elongated body.

Preferably the part of the friction surface that is adapted to pull in the elongated body defines an approximate half circle.

According to a first preferred embodiment, the moveable friction surfaces are two or more wheels or drums. The wheels or drums are preferably angled so that the elongated body in the area between two consecutive wheels or drums chiefly follows mutual tangents to the wheels or drums.

According to the second preferred embodiment, the device is made up of modules, wherein each module comprises an endless belt, a support for the endless belt and a propulsion unit for the endless belt.

Preferably this second preferred embodiment is constructed of two groups of modules, each group consisting of two or more parallel modules wherein the module groups are placed relative to each other such that the parts of the tracks defining arc sections are facing away from each other.

It is also preferred for this second embodiment that the module groups be offset and displaced relative to each other so that the elongated body in the area between to consecutive modules chiefly follows the mutual tangent of the two modules so that the elongated body is not exposed for sideways forces.

BRIEF DESCRIPTION OF THE DRAWINGS

Two exemplary embodiments of the invention will now be described, reference being made to the accompanying drawings, in which.

DETAILED DESCRIPTION OF THE INVENTION

EXAMPLE 1

Figure 1:
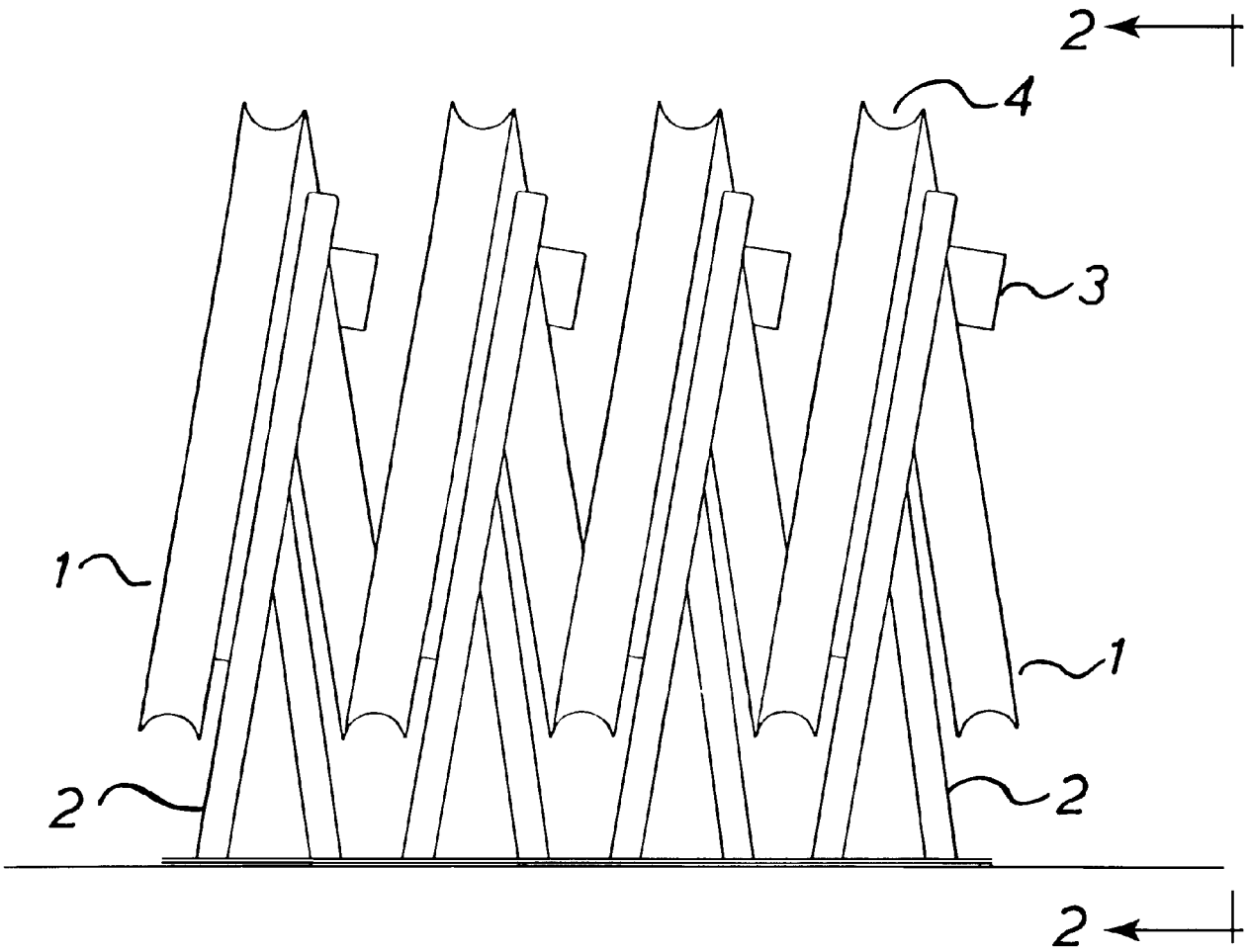
FIG. 1 is a side view of a detention unit according to the first preferred embodiment.
Figure 2:
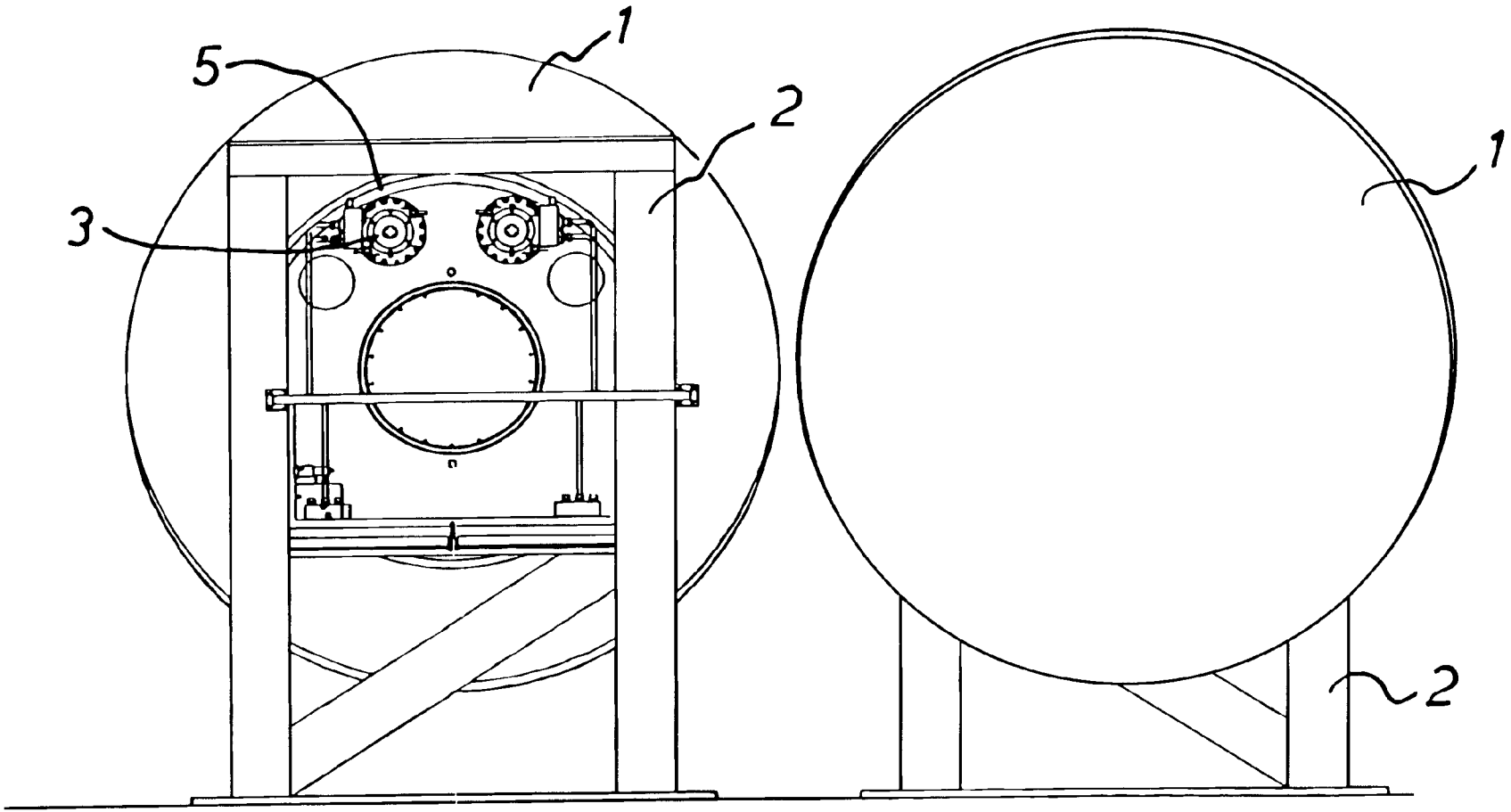
FIG. 2 is a view of the device shown in FIG. 1, taken along line 2—2 of FIG. 1.
Figure 3:
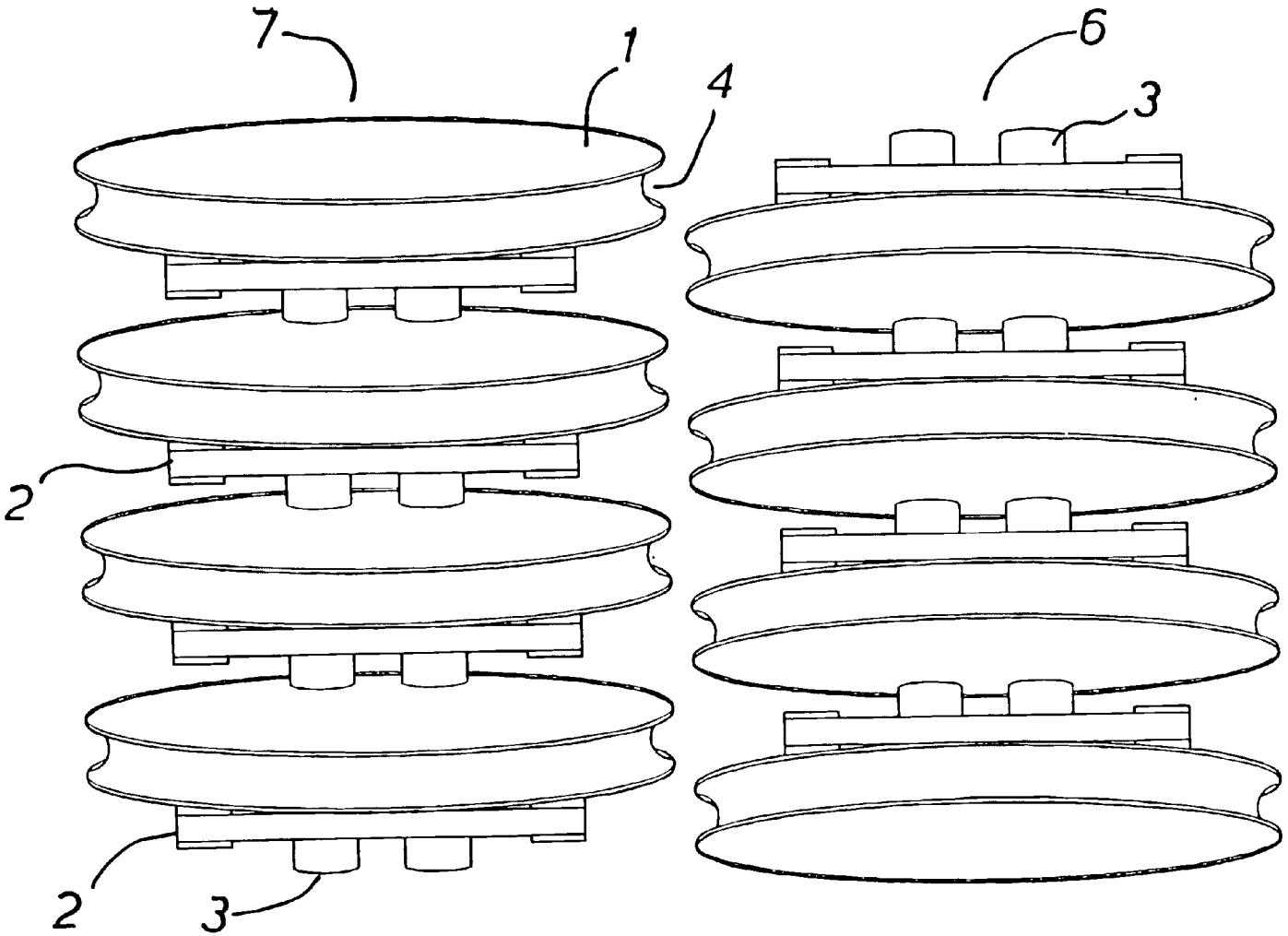
FIG. 3 is a top plan view of the device according to FIG. 1.
Figure 4:
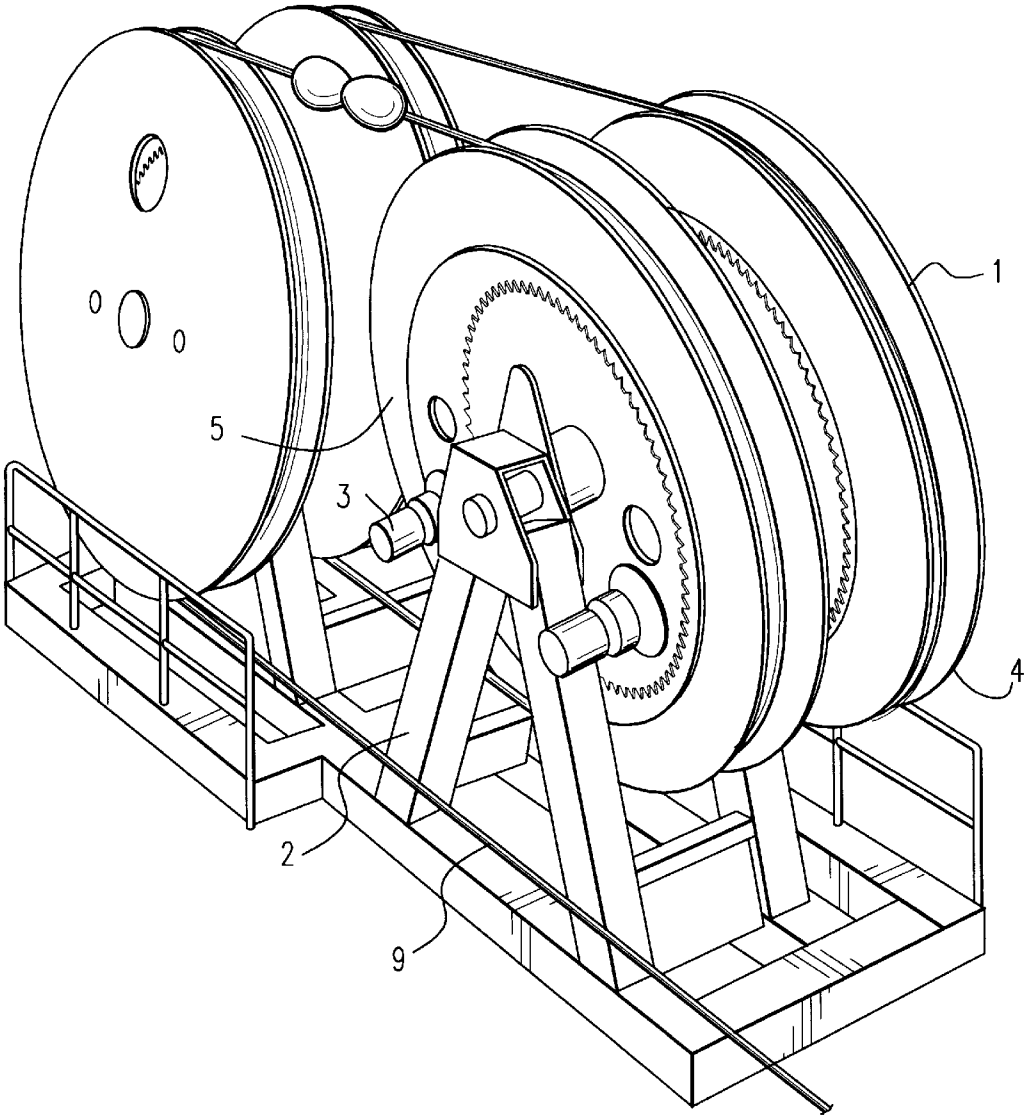
FIG. 4 is a perspective view of the device according to the first embodiment.

A first preferred embodiment where the moveable friction surfaces are wheels or drums 1, is illustrated in FIG. 1, 2 and 3. For ease of description, the word drum is used for this element herein below.

The detention unit comprises several drums 1 mounted on a supporting member 2. Each drum has its own propulsion unit 3, e.g. a hydraulic or electric motor for turning the drum 1 by means of a gear rim 5. The invention is however not limited to this exemplary means for propulsion, as what is of importance is that the propulsion of each drum 1 is separate and that the power and speed of propulsion may be separately adjusted for each drum 1.

As indicated in FIGS. 2–3, the drums 1 are placed in parallel rows 6, 7 of drums 1. The drums in each row 6, 7 are displaced relative to each other both radially and axially so that the radii are mainly parallel to each other. The axis of rotation of the drums in the same row 6, 7 are thus parallel and are inclined relative to an imaginary straight line through the centers of the drums. The radial distance between two adjacent drums 1 in the same row is preferably constant, and the radial distance in the first row 6 is preferably equal to the radial distance in the other row 7.

A cable 9 entering the device is first placed on a drum 1, preferably one of the outer drums, in one of the rows, 6, 7. The cable is placed around about one half of the circumferential surface of the drum 1. The drum 1 is preferably provided with a groove 4 to ensure centering of the cable on the circumferential surface. From the first drum, the cable 9 is led to the nearest drum in the other row to bear against half of the circumferential surface on that drum. The cable 9 is then led in the same way between rows 6,7.

To avoid sideways forces on the cable 9 in the transition from one drum to the next drum, the drums in the respective rows are tilted relative to each other so that the cable is running in an approximate helical way through the device without being pressed against the sidewalls of the groove 4.

The number of drums in a device according to the present invention may be varied according to the demand and available space. The device must have at least two drums but there is no upper limit to the number of drums. A large number of drums will ensure that the tension in the cable is distributed on several drums.

The device illustrated in FIG. 1, 2 and 3 has eight drums, four in each row 8, 7. As noted above, the cable may be placed around as many drums 1 as desirable or necessary. Optionally cable 9 may be placed around four of the drums 1, while another cable is led into the middle of the device and is placed around the remaining four drums 1. In this way two cables may be pulled in independent of each other using the same device.

The diameter of the drums 1 is adjusted according to the smallest allowable curvature for the cable 9.

EXAMPLE 2

Figure 5:
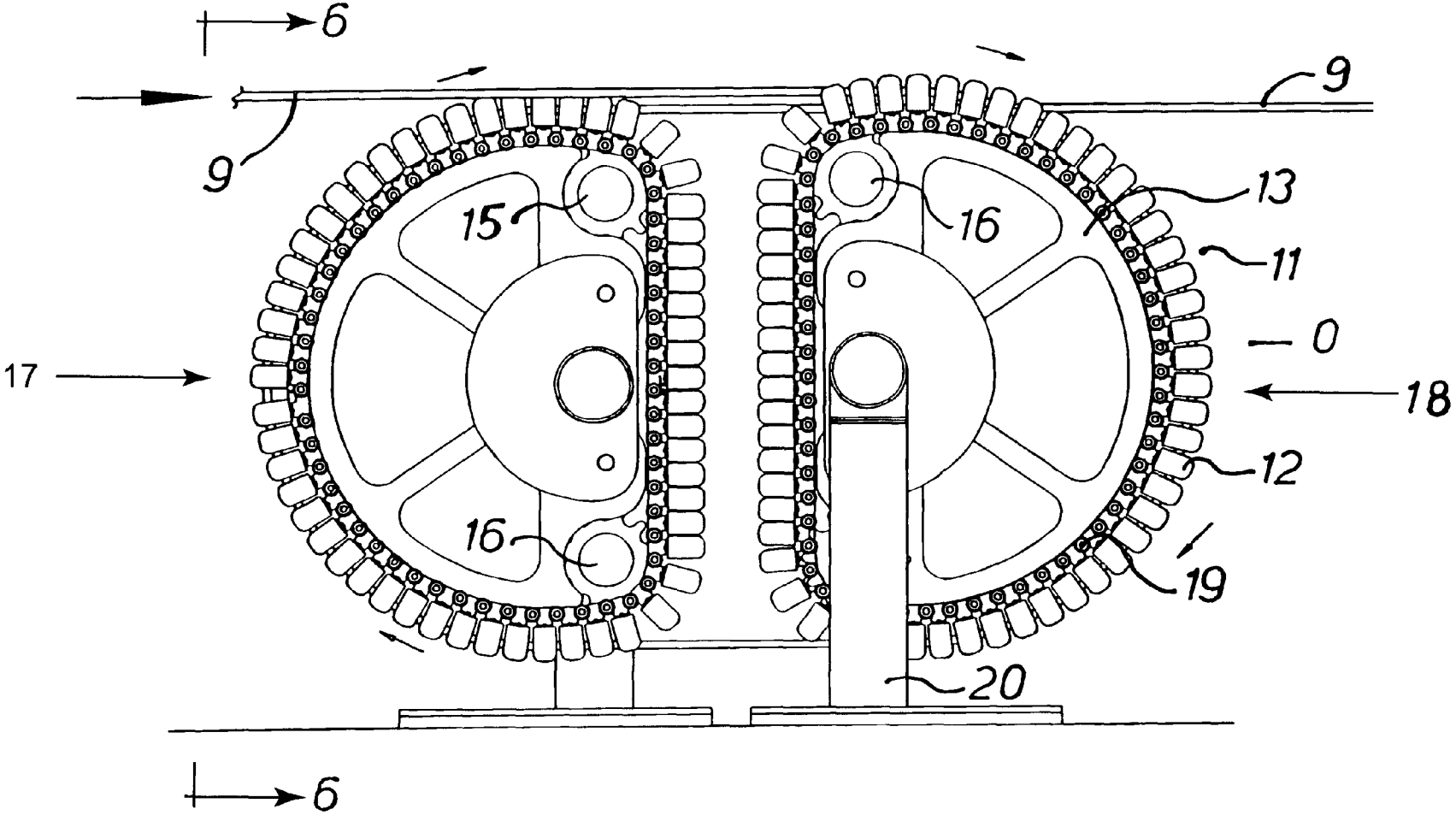
FIG. 5 is a view of the second preferred embodiment, seen from the side.
Figure 6:
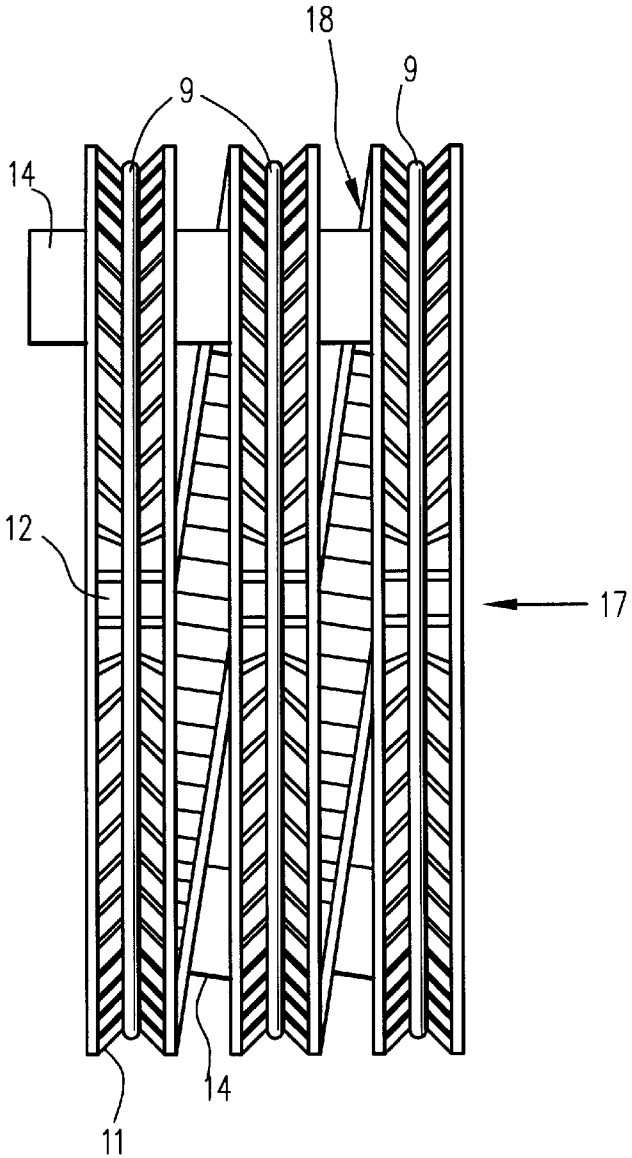
FIG. 6 is a view of the device shown in FIG. 5, taken along line 6—6.

A second preferred embodiment of the invention is illustrated in FIGS. 5 and 6.

FIG. 5 is a side view of this second preferred embodiment illustrating both the separate modules 10 and the relationship between the modules in the unit. Each module comprises a conveyor 11 made up of a plurality of blocks 12. The blocks 12 are preferably U-shaped to make a groove on the conveyor 11 to stabilize the elongated body 9.

The conveyor 11 is an endless belt resting and sliding on a track 13 having the shape of a half circle. Each track is mounted on a separate support 20. A motor 14 is provided in one comer of the half circle shaped track moving the conveyor by means of a propulsion wheel 15. Another wheel 16 is placed in the other comer of the half circle. This other wheel 16 may or may not be driven by a motor.

Depending on the strain on the conveyor 11 and the choice of materials, rollers 19 may be provided on the track 13. As an alternative to rollers, a sliding plane may be provided, optionally lubricated, e.g., with water when the device is being used.

To keep the conveyor 11 on the track 13, the track 13 may be provided with rims (not shown), or with one or more grooves.

In the device illustrated in FIG. 6 the modules are placed in a first module group 17, having three modules in parallel, and a second module group 18 having two parallel modules. The two module groups are mounted in respect to each other so that the straight sides of the first and second module groups, receptively, face each other, without touching, and so that the two groups are angled with respect to each other.

A cable 9 entering the device is first placed on a conveyor 11, preferably on one of the outer modules, in one of the module groups 17, 18. The cable is placed around the half circle surface of the module 10. The U-shape of the blocks 13 results in a longitudinal groove on the conveyor 11 to ensure centering of the cable 9 on the conveyor. From the first module, the cable 9 is led to the nearest module in the other group of modules, to bear against the half circle surface on this module. The cable 9 is then led in the same way between the groups of modules 17, 18.

The oblique position of the modules in respect to each other is adjusted so that the cable is not exposed for sideways force in the transition from one module in the first module group 17 to a module in the second module group 18 and vice versa.

In the illustrated device, the cable 9 runs twice around the device from the inlet for the cable 9 to the outlet for the cable 9 and is resting on the whole of or a part of five modules 10 in the shape of half circles. Each of the modules 10 has a separate conveyor 11 driven by its own separate driving wheel 15 propelled by a separate motor 14. The motor 14 is preferably load controlled so that the device may be controlled to distribute the tension in the cable 9 as evenly as possible on all modules. In this way the cable 9 is evenly loaded without any local destructive load.

The cable 9 is led in a controlled track on the conveyors 11 and is not exposed for sideways strain or motion against the support, thereby to substantially minimize the risk of damaging the cable 9.

Compared with the first preferred embodiment having wheels or drums, this second embodiment is smaller.

The diameter of the curved part of the conveyor is larger than the smallest allowable curvature for the cable 9.

The detention unit of the second embodiment has been described as having five modules, three in the first module group 17, and two in the other module group 18. Depending on demand and available space, however, the detention unit may consist of a different number of modules.

What is claimed is:

1. A detention unit for retrieval of an elongated body, comprising:

first and second sets of movable friction surfaces, said first set including at least first and second movable friction surfaces, each said movable friction surface of said first set being provided with and operatively coupled to a respective, separate propulsion unit, said second set including at least one movable friction surface, each said movable friction surface of said second set being provided with and operatively coupled to a respective, separate propulsion unit;

each movable friction surface including an arc section for receiving and pulling the elongated body; and said sets of movable friction surfaces being disposed in mutually opposed relation and said elongated body extending sequentially therebetween whereby said elongated body extends sequentially from the arc section of said first movable friction surface of said first set to the arc section of a first movable friction surface of said second set and then to the arc section of said second movable friction surface of said first set.

2. A detention unit as in claim 1, wherein a plane of said first movable friction surface of said first set that includes said arc section thereof is inclined at an angle of greater than zero degrees with respect to a plane of said first movable friction surface of said second set that includes the arc section thereof.

3. A detention unit as in claim 2, wherein said sets of movable friction surfaces are opposed and said planes are inclined with respect to one another such that a tangent to the arc surface of the first movable friction surface of said first set at a point of departure of said elongated body is in said plane of said first movable friction surface of said first set and is a tangent to the arc surface of the first movable friction surface of said second set and is in said plane of said first movable friction surface of said second set.

4. A detention unit as in claim 1, wherein each said arc section of the friction surface adapted to pull the elongated body defines an approximate half circle.

5. A detention unit as in claim 1, wherein each said movable friction surface comprises a friction wheel and each said movable friction surfaces is a part of a circumferential surface of a respective wheel.

6. A detention unit as in claim 1, wherein each said movable friction surface comprises a module, each module including an endless belt, a support for the endless belt and said propulsion unit therefor.

7. A detention unit as in claim 6, wherein said first and second sets comprise first and second groups of modules, each said group comprising at least two parallel modules.

8. A detention unit as in claim 7, wherein each said module includes an arched portion and wherein said arched portions of one said group face away from those of the other said group.

9. A detention unit as in claim 1, wherein said movable friction surfaces of said first set are disposed in parallel to one another.

10. A detention unit as in claim 1, wherein a plane of each movable friction surface of said first set that includes said arc section thereof and a plane of each movable friction surface of said second set that includes the arc section thereof are each inclined with respect to a vertical plane and with respect to each other.

11. A detection unit for retrieval of an elongated body comprising:

first and second sets of movable friction surfaces, each said set of movable friction surfaces including at least one movable friction surface, each said movable friction surface of each said set being provided with and operatively coupled to a respective, separate propulsion unit;

each movable friction surface including an arc section for receiving and pulling the elongated body; and said sets of movable friction surfaces being disposed in mutually opposed relation and said elongated body extending sequentially therebetween whereby said elongated body extends sequentially from the arc section of a first movable friction surface of said first set to the arc section of a first movable friction surface of said second set;

wherein a plane of said first movable friction surface of said first set that includes said arc section thereof is inclined at an angle of greater than zero degrees with respect to a plane of said first movable friction surface of said second set that includes the arc section thereof, wherein said first set comprises at least two movable friction surfaces.

12. A detention unit as in claim 11, wherein said sets of movable friction surfaces are opposed and said planes are inclined with respect to one another such that a tangent to the arc surface of the first movable friction surface of said first set at a point of departure of said elongated body is in said plane of said first movable friction surface of said first set and is a tangent to the arc surface of the first movable friction surface of said second set and is in said plane of said first movable friction surface of said second set.

13. A detention unit as in claim 11, wherein each said arc section of the friction surface adapted to pull the elongated body defines an approximate half circle.

14. A detention unit as in claim 11, wherein each said movable friction surface comprises a friction wheel and each said movable friction surfaces is a part of a circumferential surface of a respective wheel.

15. A detention unit as in claim 11, wherein said movable friction surfaces of said first set are disposed in parallel to one another.

16. A detention unit as in claim 11, wherein each of said first and second sets comprises at least two movable friction surfaces.

17. A detention unit for retrieval of an elongated body comprising:

first and second sets of movable friction surfaces, each said set of movable friction surfaces including at least one movable friction surface, each said movable friction surface of each said set being provided with and operatively coupled to a respective, separate propulsion unit;

each movable friction surface including an arc section for receiving and pulling the elongated body; and said sets of movable friction surfaces being disposed in mutually opposed relation and said elongated body extending sequentially therebetween whereby said elongated body extends sequentially from the arc section of a first movable friction surface of said first set to the arc section of a first movable friction surface of said second set;

wherein a plane of said first movable friction surface of said first set that includes said arc section thereof is inclined at an angle of greater than zero degrees with respect to a plane of said first movable friction surface of said second set that includes the arc section thereof, wherein each said movable friction surface comprises a module, each module including an endless belt, a support for the endless belt and said propulsion unit therefor.

18. A detention unit as in claim 17, wherein said first and second sets comprise first and second groups of modules, each said group comprising at least two parallel modules.

19. A detention unit as in claim 18, wherein each said module includes an arched portion and wherein said arched portions of one said group face away from those of the other said group.

* * * * *